US005714961A

United States Patent [19]

Kot et al.

[11] Patent Number: 5,714,961

[45] Date of Patent: Feb. 3, 1998

[54] PLANAR ANTENNA DIRECTIONAL IN AZIMUTH AND/OR ELEVATION

[75] Inventors: John Seward Kot, Manly; Trevor Stanley Bird; Nasiha Nikolic, both of Eastwood, all of Australia

[73] Assignee: Commonwealth Scientific and Industrial Research Organisation, Campbell, Australia

[21] Appl. No.: 659,068

[22] Filed: Jun. 4, 1996

Related U.S. Application Data

[63] Continuation of Ser. No. 268,180, Jun. 28, 1994, abandoned.

[30] Foreign Application Priority Data

Jul. 1, 1993 [AU] Australia ..... PL9739

[51] Int. Cl.[6] ..... H01Q 1/38; H01Q 13/10

[52] U.S. Cl. ..... 343/769; 343/770; 343/700 MS

[58] Field of Search ..... 343/769, 767, 343/768, 770, 700 MS; H01Q 1/38, 13/10, 13/12

[56] References Cited

U.S. PATENT DOCUMENTS

| | | | |
|---|---|---|---|
| 4,208,660 | 6/1980 | McOwen, Jr. | 343/769 |
| 4,229,744 | 10/1980 | Luedtke et al. | 343/769 |
| 4,320,402 | 3/1982 | Bowen | 343/700 MS |
| 4,947,178 | 8/1990 | Shafai | 343/769 |
| 5,006,859 | 4/1991 | Wong et al. | 343/830 |
| 5,061,943 | 10/1991 | Rammos | 343/770 |
| 5,252,979 | 10/1993 | Nysen | 342/50 |
| 5,280,297 | 1/1994 | Profera, Jr. | 343/700 MS |

FOREIGN PATENT DOCUMENTS

| | | |
|---|---|---|
| 1305249 | 7/1992 | Canada . |
| 2 005 922 | 4/1979 | United Kingdom . |

OTHER PUBLICATIONS

IEEE Transactions on Antennas and Propagation, vol. AP-32, No. 4, Apr. 1984, Coleman, H.P. et al A Compact Flush-Mounting Antenna . . . , pp. 412-414.

Navy Technical Disclosure Bulletin, vol. 8, No. 2, Dec. '82 Navy Tech. Cat. No. 0261 Navy Case No. 65404 Coleman, H.P. et al, A Flush-Mounting, Multi-Modal Antenna pp. 49-54.

*Primary Examiner*—Hoanganh T. Le
*Attorney, Agent, or Firm*—Graham & James LLP

[57] ABSTRACT

A directional planar antenna is disclosed. The antenna has an array of coaxial ring-slot radiating elements formed through a conductive layer on a dielectric substrate. A number of probes, coupled to the ring-slot elements, selectively excite a separate resonant mode on each ring-slot element. The resonant mode supported by a ring-slot element depends upon the geometry of that ring-slot element. The resonant modes combine in the far field to form a radiation pattern directional in azimuth and elevation. By adjustment of the relative phase difference or relative amplitude between the excited modes, the radiation pattern can be steered.

16 Claims, 15 Drawing Sheets

PLANAR ANTENNA DIRECTIONAL IN AZIMUTH AND/OR ELEVATION

This is a Continuation of application Ser. No. 08/268,180 filed Jun. 28, 1994, now abandoned.

FIELD OF THE INVENTION

The present invention relates to planar antennas and particularly, but not exclusively, to antennas having directional azimuthal and elevation radiation patterns that can be modified.

The preferred embodiment of the antenna described finds particular application in a wireless local area network (WLAN) operating at 30–300 GHz, and preferably at approximately 60 GHz. Such an antenna plays an important part in communications between portable computing devices and/or peripherals and the remainder of a local area network. It is desirable in such an application to have an antenna with a 'beam' (radiation pattern) that can be steered in azimuth electronically. Alternatively, this steering property can be used to form an adaptive antenna for use in environments where there is an interfering signal, in which case the null's of the antenna can be steered electronically to minimise the interference caused by a competing signal. It is further desirable to be able to modify the beam pattern in elevation.

It is the object of the present invention to produce such an antenna.

DISCLOSURE OF THE INVENTION

According to one aspect of the present invention there is disclosed a planar antenna comprising an electrically conductive layer on a dielectric substrate, the conductive layer defining a plurality of ring-slot radiating elements formed therethrough, and signal feed means coupled to each slot-ring radiating element, and wherein the feed means excites a resonant mode on each of the ring-slot elements, said ring-slot elements being configured so that the resonant modes combine to produce a directional radiation pattern.

Preferably, the ring-slot radiating elements are in a coaxial configuration. The feed means can be further controllable to adjust the relative phase between each excited mode so that the radiation pattern is steerable in azimuth. Further preferably, the mode excited on each ring-slot element results from the geometry of the ring-slot element.

The invention further discloses a wireless local area network including a plurality of planar antennas as described immediately above.

In accordance with yet another aspect of the invention, there is disclosed a method of electronically steering a planar antenna, the antenna comprising an electrically conductive surface on a dielectric substrate, the conductive layer defining a plurality of ring-slot elements formed therethrough, and signal feed means coupled to each ring-slot element, the method comprising the steps of:

exciting a resonant mode on each of thee ring-slot elements, the ring-slot elements being configured so that the resonant modes combine to produce a directional radiation pattern; and adjusting the relative phase between each resonant mode by electronic phase shifting means to steer the radiation pattern in azimuth.

Preferably, the method comprises the further step of configuring the geometry of each ring-slot element to support only a desired resonant mode, thus shaping the radiation pattern in elevation.

BRIEF DESCRIPTION OF THE DRAWINGS

Preferred embodiments of the antenna of the present invention will now be described with reference to the drawings, in which.

DESCRIPTION OF PREFERRED EMBODIMENTS

Figure 1:
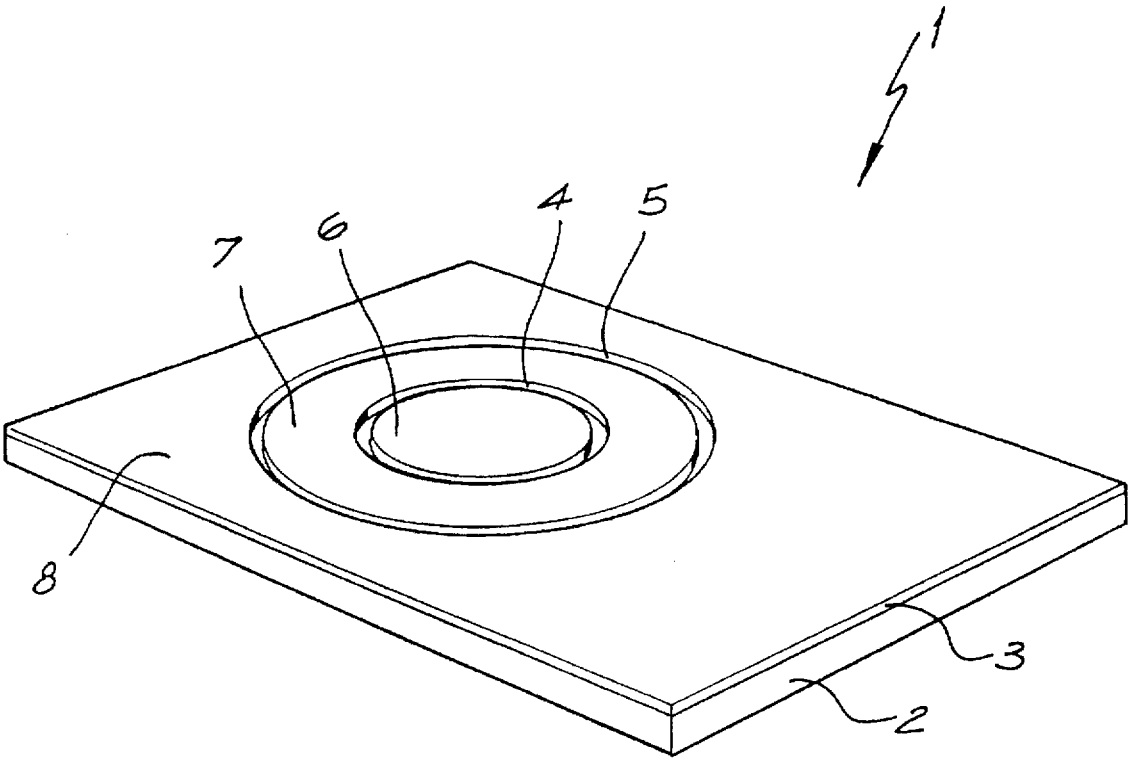
FIG. 1 is a perspective view from above of the antenna of one embodiment.

As seen in FIG. 1, the array antenna 1 of a preferred embodiment is formed on a dielectric substrate 2 which carries a conductive layer 3 on its upper surface. Two coaxial ring-slot elements 4 and 5 are etched through (defined by) the conductive layer 3 to form three regions, which are respectively an inner conductor 6, a band conductor 7 and an outer conductor 8. All of the conductors 6–8 act as a ground plane (reference) for the antenna. The 'depth' of the slots 4, 5 must be such as to be completely through the conductive layer 3. Because of the particular geometry chosen, and because the slots 4, 5 are circular and concentric, the inner conductor 6 is a circular disc and the band conductor 7 is a circular annulus.

Figure 2:
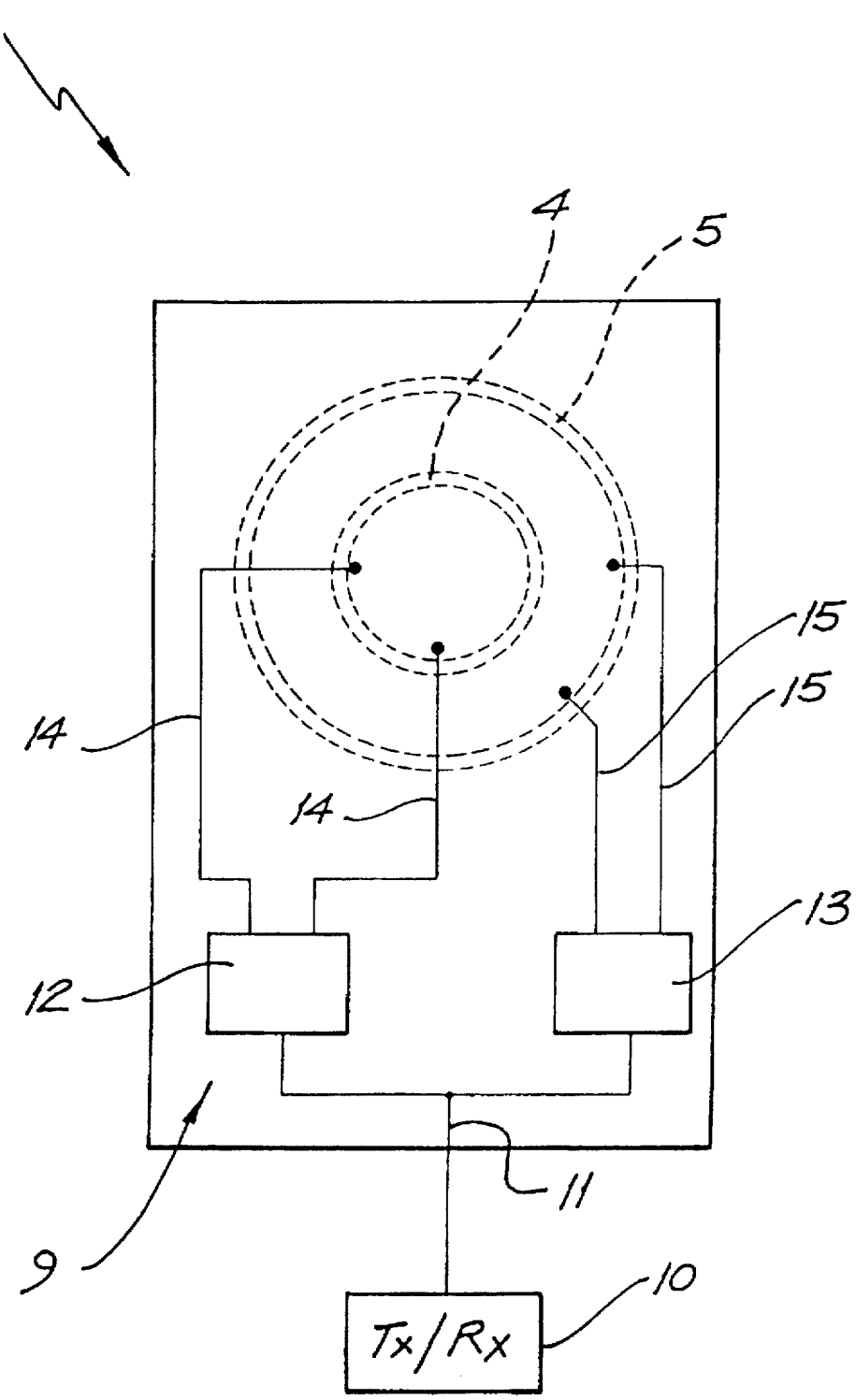
FIG. 2 is an inverted plan view of the antenna of FIG. 1.

FIG. 2 illustrates a feed network 9 which acts to provide the excitation for the two ring-slots 4, 5. The feed network 9 conveniently is arranged on the underside of the substrate 2. A transmitter/receiver ($T_x/R_x$) 10 connects to a feeder micro-strip transmission line 11, which is branched to supply each of two power dividers/phase shifters 12, 13, preferably realised either by gallium arsenide integrated circuits or by means of hybrid circuits. Each of the circuits 12, 13 has corresponding micro-strip transmission line probes 14, 15 that serve to excite the ring-slots 4,5. The probes 14,15 terminate beneath the respective slots 4, 5 and couple the excitation energy to the ring-slots 4, 5.

Operation of the antenna 1 can be understood in terms of the radiation from the individual ring-slots 4,5 making up the coaxial array.

A single ring-slot antenna has the form of a slot transmission-line, connected in a circular loop. This forms a resonator, the resonant modes of which correspond to excitation frequencies for which the effective circumference of the ring is equal to an integral number of wavelengths of the guided wave on the slot. The effective wavelength of the guided wave is somewhere between that in free space and that in the dielectric substrate. The resonant modes are standing waves resulting from the superposition of running-wave resonances which travel clockwise and anticlockwise around the loop. At these resonant frequencies, the azimuthal ($\phi$) dependence of the electric field carried by the slot has the form $c^{jn\phi}$, where n is an integer in the range $-\infty$ to $\infty$, corresponding to the n-th mode of the resonator. Accordingly, the field in the slot is represented as Fourier modes in the $\phi$ direction.

To find the radial dependence of the field on the slot, it can be assumed that the slot width is small compared to the free-space wavelength of the signal. The electric field on the slot then can be taken to be a purely radial field $E_r$, with radial dependence $E=1/\rho$, where $\rho$ is the radial distance for the axis of the ring-slot.

Figure 3:
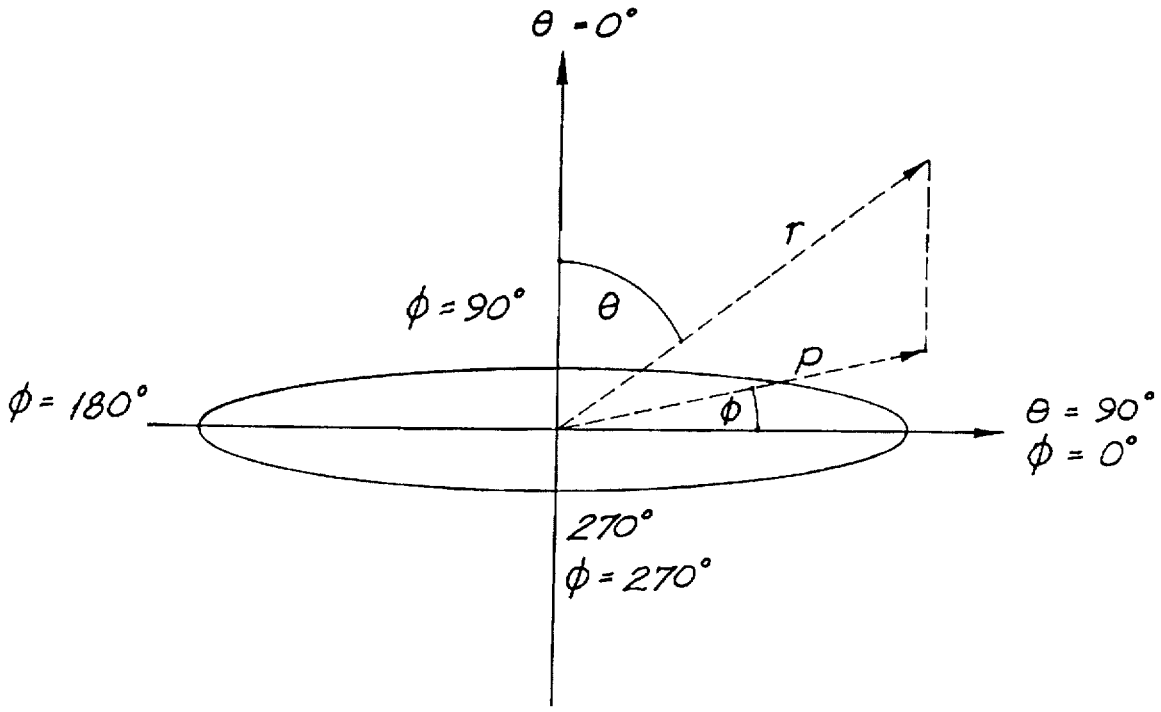
FIG. 3 indicates angles for the antenna geometry.

Having found the form of the electric field on a single circular slot, the far-field radiation pattern for the slot can be determined. It can be shown (see K. D. Stephen et al. IE Trans. Microwave Theory Tech., Vol. MT-31, No. 2, February 1983, pp.164–170) that the far-field radiation pattern for this type of the field distribution is such that the far field of the n-th mode is expressible in terms of the (n+1)-th order Hankel transform of the slot electric field E, given by:

$$\bar{E}_{(\pm)}(\alpha) = \int_a^b E(\rho)\, J_{n\pm1}(\alpha\rho)\, d\rho \tag{1}$$

where a and b are the inner and outer radius of the ring, and $J_n$ is the Bessel function of the first kind of order n. Then the far-field electric field components $E_\theta$ and $E_\phi$ are given (neglecting unimportant terms for clarity) by:

$$\bar{E}_\theta(r,\theta,\phi) = -k_o \frac{e^{-jk_o r}}{r}\, j^n \frac{e^{jn\phi}}{2}\, \bar{E}_o(k_o \sin\theta) \tag{2}$$

and $$\bar{E}_\phi(r,\theta,\phi) = -k_o \frac{e^{-jk_o r}}{r}\, j^{n+1} \frac{e^{jn\phi}}{2}\, \cos\theta\, \bar{E}_e(k_o \sin\theta) \tag{3}$$

where $$\bar{E}_o(\alpha) = \bar{E}_{(+)}(\alpha) - \bar{E}_{(-)}(\alpha) \tag{4}$$

$$\bar{E}_e(\alpha) = \bar{E}_{(+)}(\alpha) + \bar{E}_{(-)}(\alpha) \tag{5}$$

are odd and even parts of the Hankel transform (1), $k_o = 2\pi/\lambda$, where $\lambda$ is the wavelength in free space, and the variables, r, 0 (elevation) and $\phi$ (azimuth) are defined in FIG. 3.

It is possible to independently excite the individual Fourier modes on the antenna by appropriate choice of the circumference of a ring-slot resonator. Thus mode 1 (n=1) has a main lobe along the axis of the loop, whereas all higher order modes (n=2 or greater) have a null along the loop axis. The radiation patterns in elevation for the first three modes (n=1, 2, 3) for a theorised single ring-slot antenna are shown in FIG. 1. The indices on the horizontal axis (0.25, 0.5, 0.75 and 1) represent a normalised measure of signal strength. From the two equations (2) and (3) immediately above it will be apparent that the radiation patterns of the individual Fourier modes are circularly symmetric.

The two ring slot array antenna previously shown in FIGS. 1 and 2 has the radius of each ring 4, 5 chosen so that it supports a separate resonant mode at the centre frequency of operation of the antenna. As follows from above, the resultant far-field radiation pattern for the antenna 1 can be found by the superposition of the far field radiation patterns of the individual modes excited on each ring-slot. It can be seen from equations (1)–(3) above, that for the case of slots of infinitesimal width, the far-field patterns for all the modes form a set of Bessel functions in $k_o \sin(\theta)$, which can be used as a basis for the synthesis of far-field patterns having some desired elevation pattern, using the methods of the discrete Hankel transform. For finite-width slots this still applies, although the synthesis procedure is less standard.

Of more immediate application to WLAN antennas, it can be seen from equations (2)–(3) above that the far field radiation patterns have a $\phi$-dependence of the form $e^{jn\phi}$. This means that given a particular desired azimuthal pattern, $f(\phi)$, an approximation to this pattern, $f_n(\phi)$, can be obtained using standard Fourier series methods.

Figure 4:
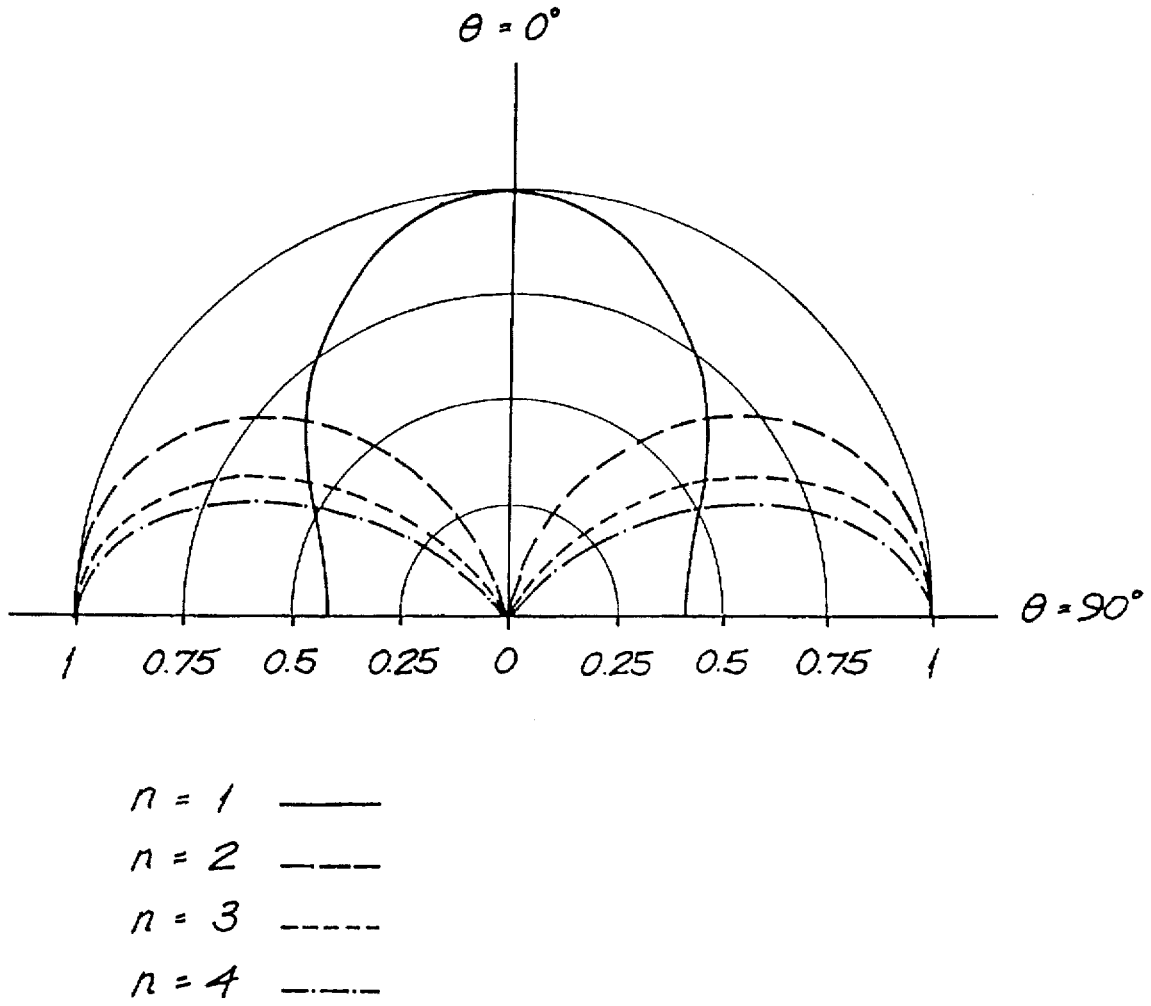
FIG. 4 is a sectional view of possible elevation radiation patterns for a single ring-slot antenna.

The $\theta$-dependence is a direct function of the modal number excited on each of the two ring-slots 4,5, and the resultant far-field radiation pattern can be determined by the superposition of the respective modal patterns of a single ring-slot structure, for example, as shown in FIG. 4. Thus by appropriate choice of mode numbers, a desired far-field elevation pattern can be shaped.

Figure 5:
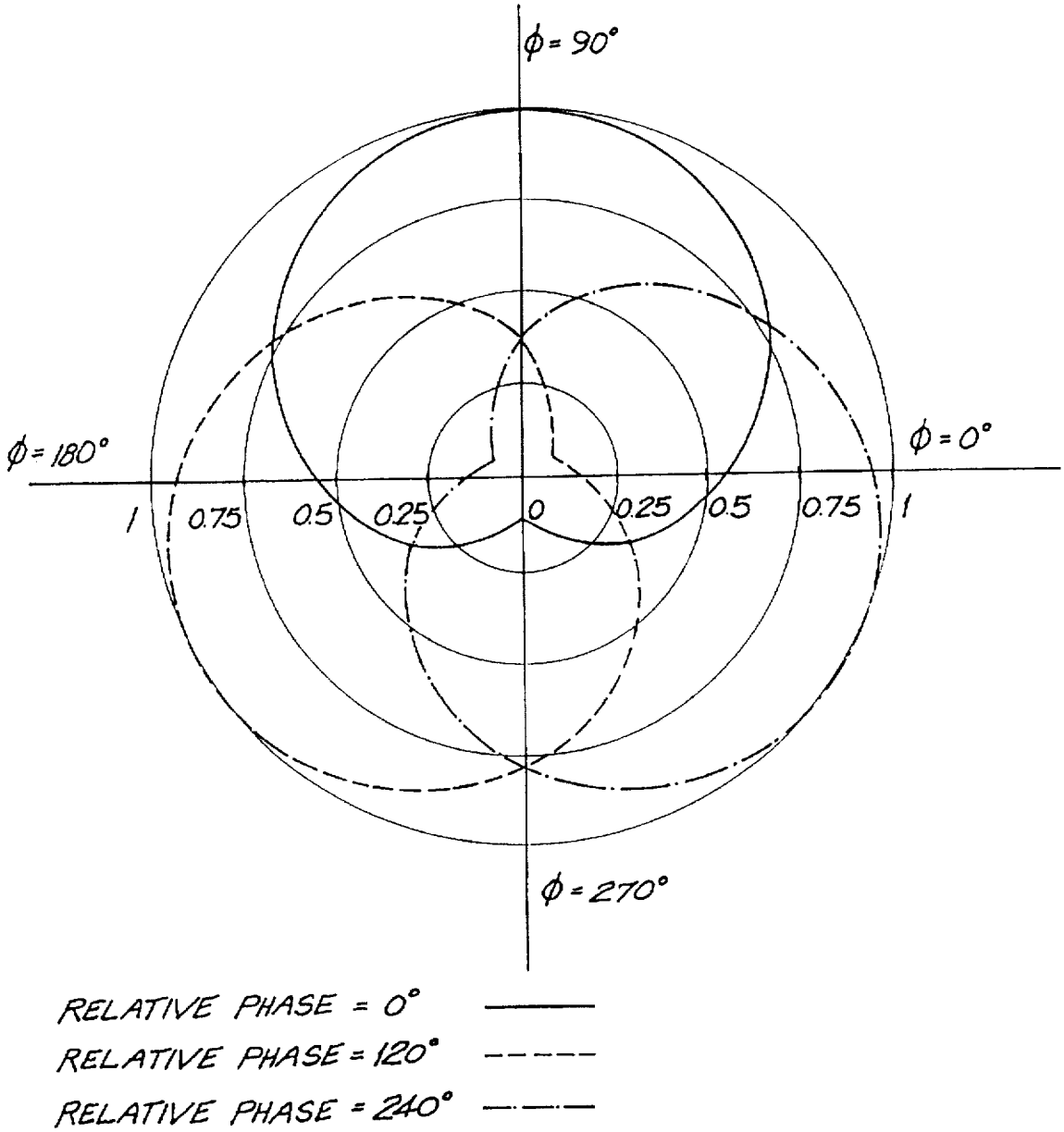
FIG. 5 is a plan view showing beam steering in azimuth for a two ring-slot antenna.

As a simple example, consider the two ring-slot array shown in FIGS. 1 and 2 supporting mode numbers n=+2 (on the inner ring slot 4) and n=+3 (on the outer ring-slot 5), with equal amplitudes, but with varying relative phases between the modes. FIG. 5 shows the resulting far-field azimuthal patterns, representing the scalar magnitude of the electric field, for relative phase differences of 0, 120, and 240 degrees respectively. The indices on the horizontal axis again represent normalised signal strength. It can be seen that the resulting far-field pattern has the form of a beam which is steerable through 360° in azimuth by adjusting the relative phase of the two modes. If this is achieved by means of a phase shifting device, the beam can then be electronically steered.

For WLAN applications, steerability has immediate advantage in directing an antenna to communicate with components elements of the local area network. Alternatively, or complementarily, the null's in the azimuth pattern can be steered to minimise interference from competing transmissions.

The steering characteristic also has application in scanning antennas, whether that be over a narrow azimuthal aperture or through the complete 360° range.

The set of far-field radiation patterns which can be approximated to some given tolerance can be increased by increasing the number of ring-slots in a coaxial array and hence the number of modes which can be excited on the array. The greater the number of modes, generally the greater the number of lobes in the polar pattern.

Further modelled azimuthal and elevation data shall be described to illustrate the steering function.

Figure 6A:
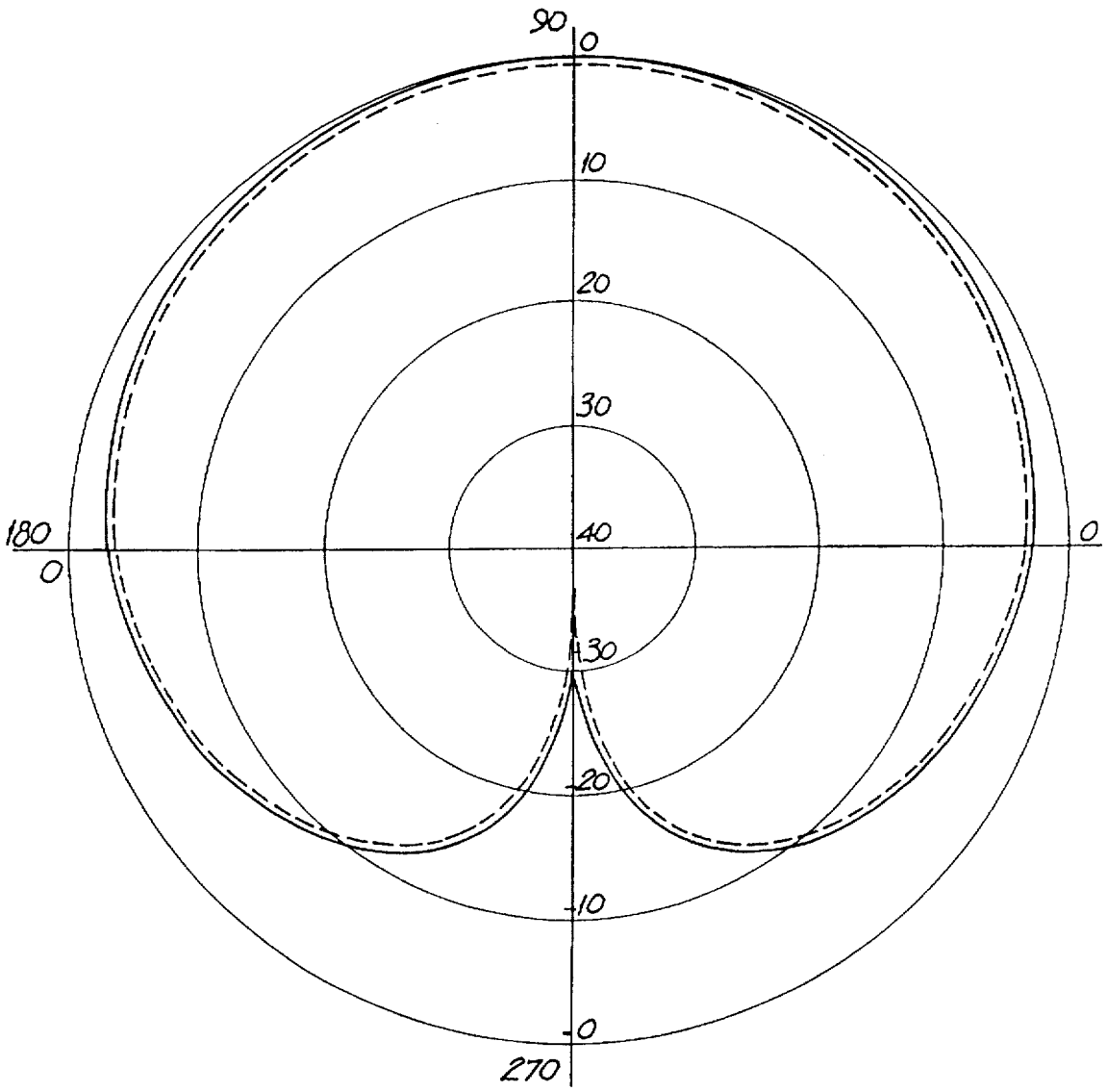
FIGS. 6A and 6B are plan views respectively of an azimuthal radiation pattern and an elevation radiation pattern for an antenna supporting modes n=+1 and n=+2.
Figure 6B:
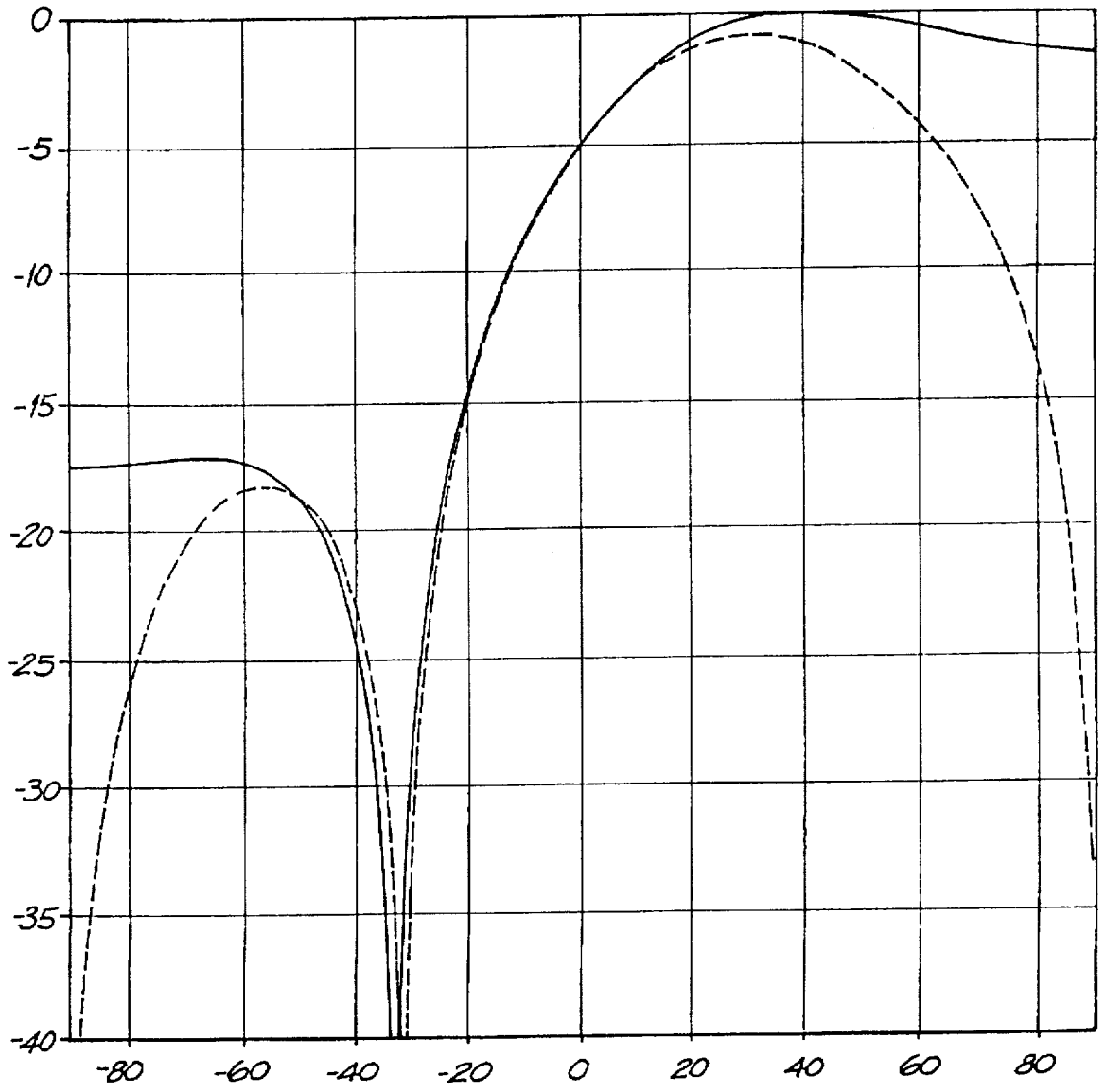

FIGS. 6A and 6B respectively are azimuth and elevation radiation patterns for a two ring-slot antenna, similar to that shown in FIGS. 1 and 2. The antenna supports two modes, n=+1 and n=+2, and being of equal amplitude. In FIG. 6A, the radial scale is in respect of relative power measured in dB, whilst the circumferential scale of azimuth is in degrees. The plot shows the shaped nature of the azimuth pattern, having a back-to-front ratio of about 30 dB. The plot shows both of the two orthogonal electric field components, $E_\theta$ and $E_\phi$, respectively represented as the solid and dashed lines. It will be apparent that by arrangement of a relative phase difference between the modes excited on the ring-slot antenna that the azimuthal beam pattern can be steered, in the manner previously described and as shown in FIG. 5.

FIG. 6B, as noted, shows the elevation radiation pattern for the modes n=+1 and n=+2 excited with equal amplitude. The vertical scale represents relative power in dB, the horizontal scale is elevation angles in degrees, and the solid and dotted lines correspond to the two orthogonal electric field components $E_\theta$ and $E_\phi$. The figure shows a cross-sectional view of the elevation pattern taken along the main lobe of the beam, i.e. in the direction of $\phi$=20°. The elevation pattern contains a null at approximately −35°.

Figure 7A:
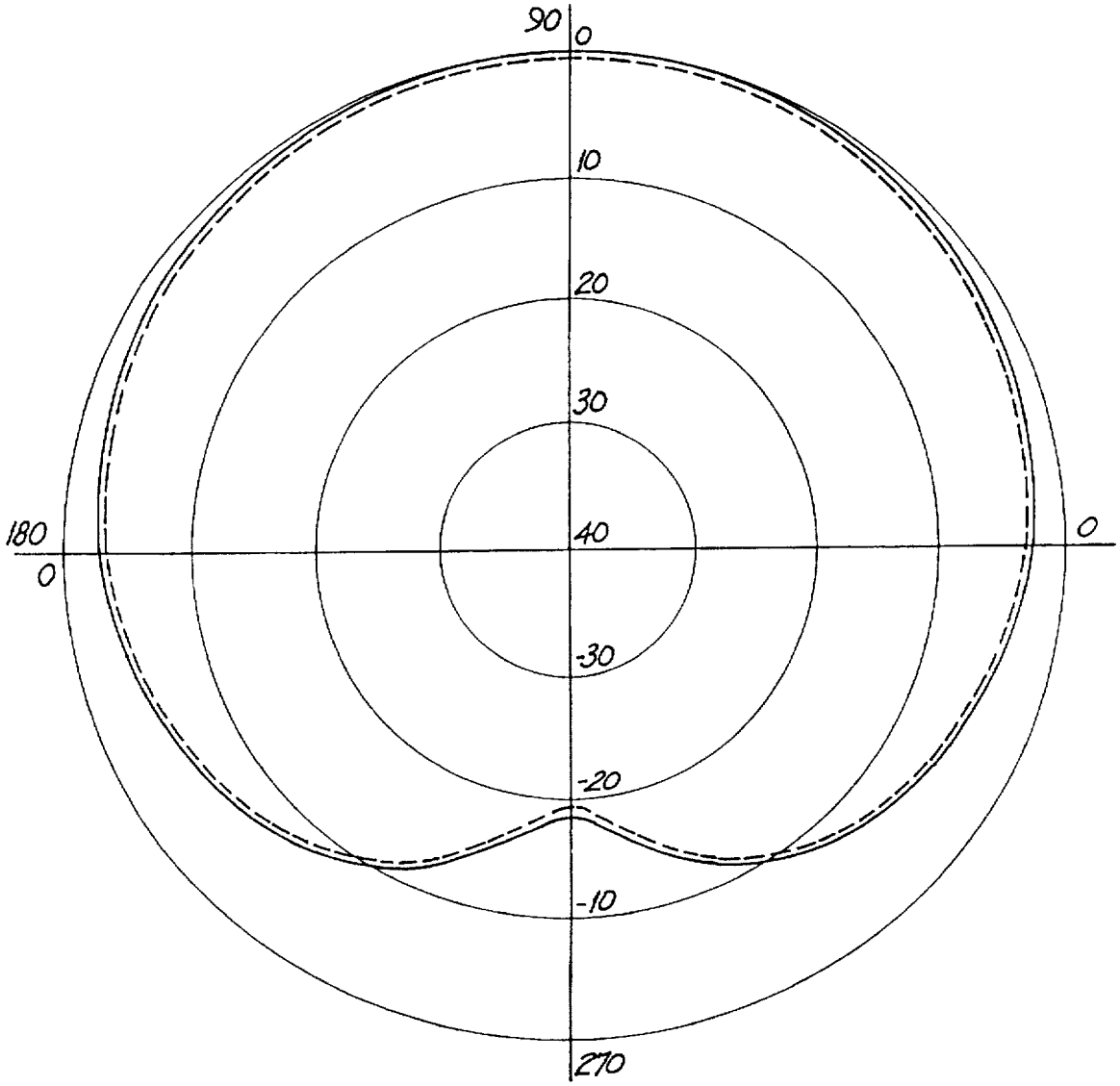
FIGS. 7A and 7B are similar azimuthal and elevation radiation patterns, but for modes n—+2 and n=+3.
Figure 7B:
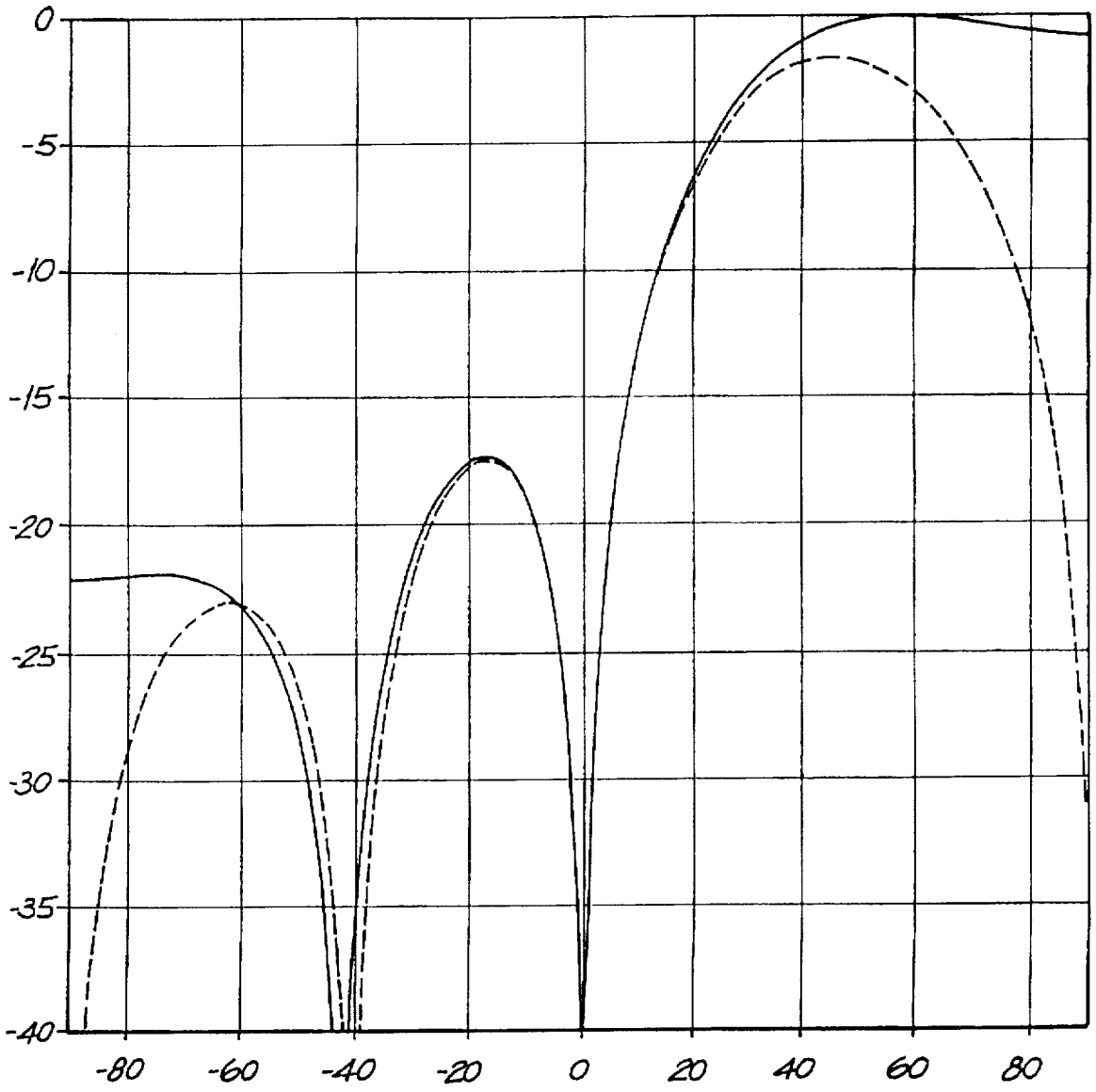

FIGS. 7A and 7B are similar representations to FIG. 6A and 6B, except being in respect of modes n=+2 and n=+3. In this respect, the azimuthal radiation pattern shown in FIG. 7A is essentially the same as that shown in FIG. 5. Interestingly, the elevation radiation pattern shown in FIG. 7B shows two null's at 0° and −45°. Thus it can be seen that by the choice of a different combination of modes to be excited on the ring-slot antenna, the elevation radiation pattern can be advantageously steered with respect to null's maxima in that pattern. As noted previously, the mode excited on each ring-slot is a function of the radial dimension of the slot.

Figure 8A:
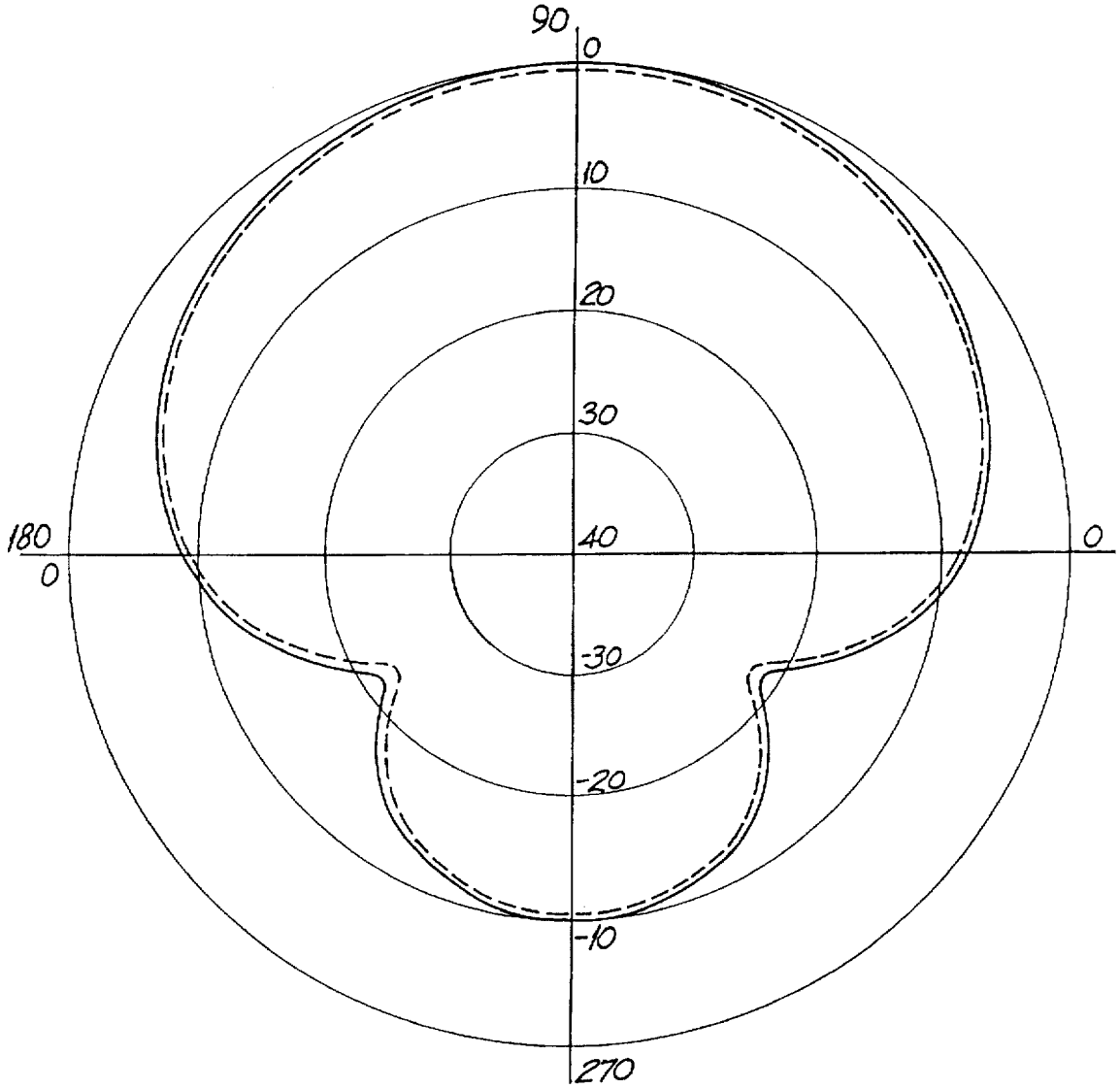
FIGS. 8A and 8B are plan views respectively of an azimuthal radiation pattern and an elevation radiation pattern for an antenna supporting three nodes n=+1, n=+2 and n=+3.
Figure 8B:
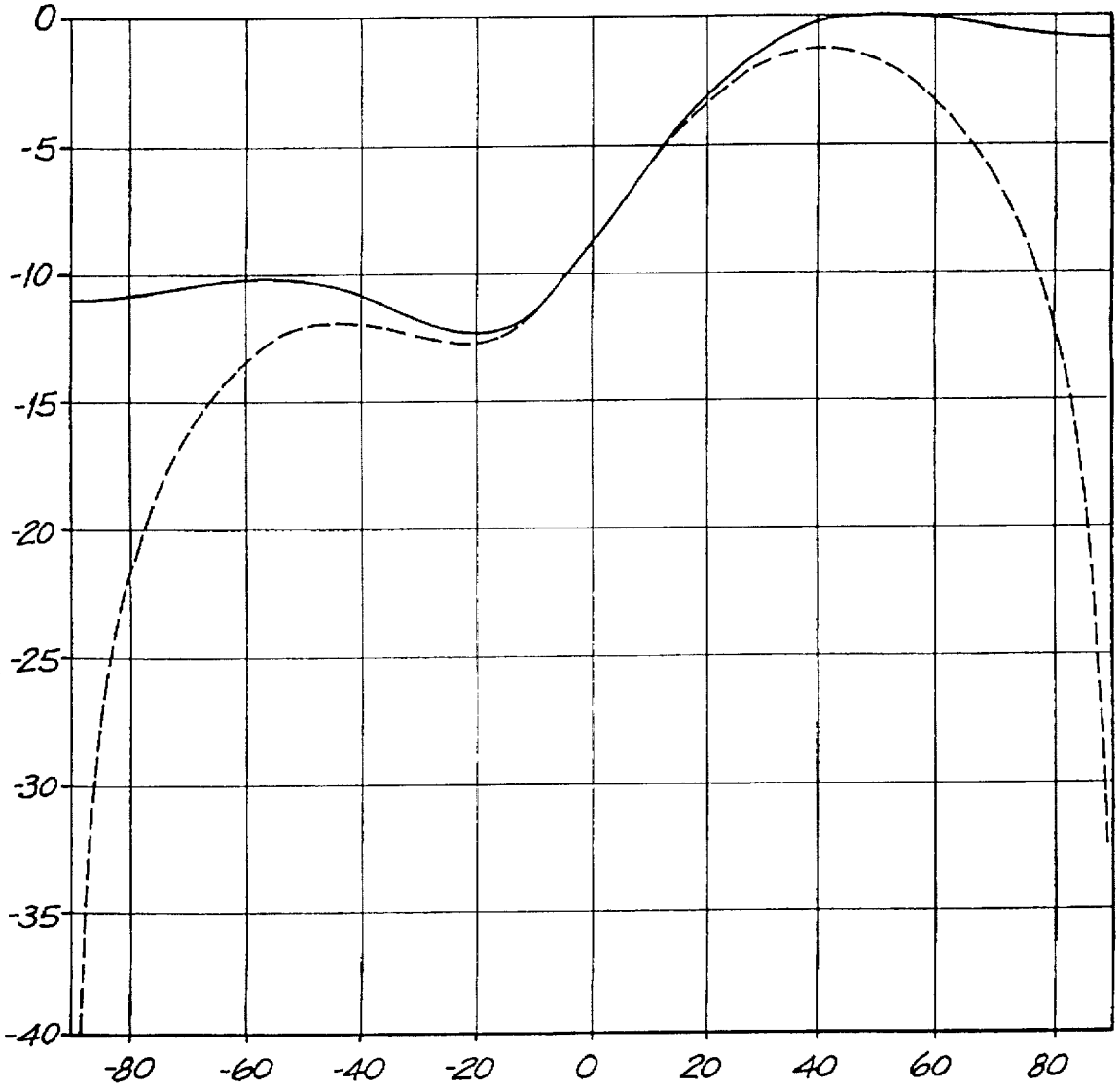

FIGS. 8A and 8B are in respect of a three ring-slot array supporting modes n=+1, n=+2 and n=+3 excited with equal amplitude. In FIG. 8A, the azimuthal radiation pattern has been plotted with the radial scale representing relative power in dB and with the circumferential azimuthal scale in degrees. Again, the solid and dotted lines correspond to the two orthogonal electric fields components, $E_\theta$ and $E_\phi$. As can be noted, the radiation pattern has minima at approximately $\phi$=215° and $\phi$=325°. Steering of the far-field azimuth pattern again is by introduction of a relative phase difference between each mode. Generally this means all three modes have a differing relative phase arrangement, although it is conceivable that the relative phase of two of the three modes may coincide.

The elevation pattern shown in FIG. 8B has a vertical scale representing relative power in dB, with the horizontal scale of elevation angle in degrees. The convention concerning the two orthogonal electrical field components is the same. Again, the cross sectional cut has been taken along the direction of the main beam, i.e. $\phi$=90°. The elevation pattern does not contain a null, and is somewhat more uniform throughout the range of elevation angles, hence can be considered to be somewhat omnidirectional with the elevation, especially in comparison with the elevation pattern shown in FIGS. 6B and 7B.

Figure 9:
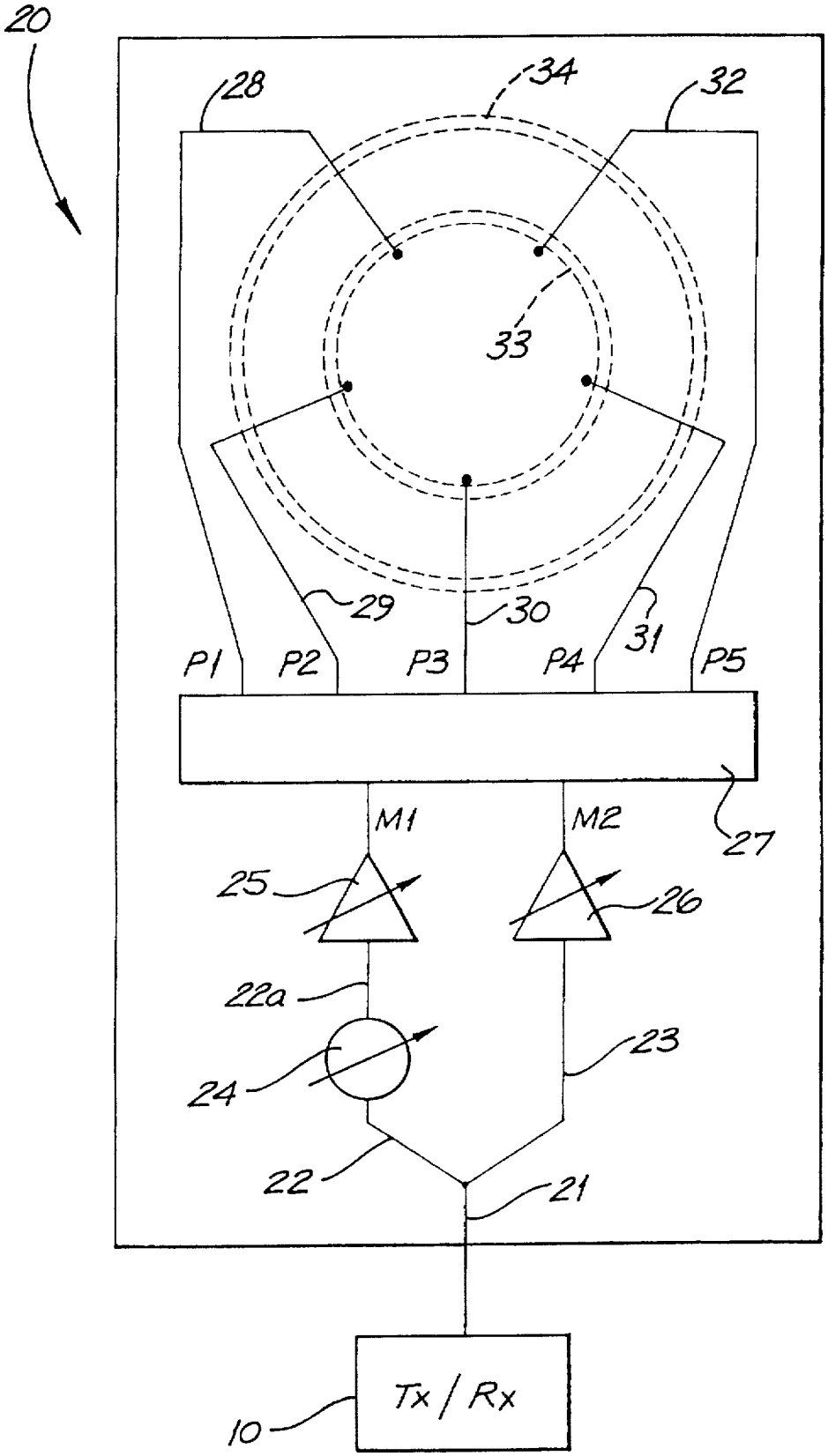
FIG. 9 is a schematic view of signal forming electronics together with a plan view of a two ring-slot antenna.

Generation of different combinations of modes can be achieved by electronic means. One way of doing this is shown in FIG. 9, which illustrates a two ring-slot antenna 20. Here, an excitation signal from the transmitter/receiver ($T_x/R_x$) 10 carried by a micro-strip feed line 21 splits into two separate feed lines 22,23, which, in turn, carry the split excitation signal with the same relative amplitude and phase. One of the feeds 22 inputs to a phase shifting device 24, and otherwise both signals carried on the feeds 22,23 separately input to a variable gain amplifier 25,26. The respective outputs from the variable amplifiers 25,26 are provided to a respective mode port M1,M2 of a beam forming network 27. The beam forming network 27 has five output probe ports P1–P5 and associated micro strip transmission probes 28–32. The probes 28–32 provide the excitation for the two ring-slots 33,34. The number (M) of mode ports of the beam forming network 27 corresponds to the number of modes to be excited. The number of probe ports is represented by N.

As previously noted, the ring-slots 33,34 are of a depth sufficient to pass completely through the conductive layer carried by the substrate. The width of the ring-slots must be small with respect to the circumference of each. The circumference corresponds to one wavelength, hence, as a guide, the width of a ring-slot should be less than 1/10 of a wavelength. By way of example, a two ring-slot antenna, such as that shown in FIG. 9, operating at 60 GHz and supporting modes n=+1 and n=+2 has ring-slot diameters of about 1.35 mm and 2.70 mm respectively.

A signal applied to a mode port is mapped by the network 27 into a set of N signals appearing at the probes 28–32 which drive the array, having the property that this set of signals excites the desired mode and no others in each ring-slot. One solution to exciting the ring-slots 33,34 is to arrange the N probes symmetrically about the array, with the number of probes N required to independently excite M modes, on an array having L ring-slots, given by:

$$N=2L+1.$$

The two ring-slot array (L=2) of FIG. 9 has the circumferences of the ring-slots chosen so that the inner ring 33 supports modes n=+1 and n=1, and the outer ring supports modes n=+2 and n=2.

For clarity, let the connections from the network 27 to the probes 28–32 be assumed initially to have negligible electrical length. The case of finite electrical length connections will be dealt with later by a simple modification. In operation of the network 27, a signal in the operating frequency band of the antenna is input via mode port M1 and divided by the network into a set of output signals at the five probe ports P1–P5. The amplitudes of the output signals at ports P1 and P5 are equal to one another. The phases of the output signals at ports P1 to P5, relative to the signal at P1, are 0, $2\pi/5$, $4\pi/5$, $6\pi/5$ and $8\pi/5$ radians respectively. This set of signals then drives the ring-slot array via the probes 28–30. For modes having mode indices n=2, n=−1, n=0, n=+1, and n=+2, this excitation is orthogonal to all modes apart from mode number n=+1, and hence excites this mode and no others. Similarly, a signal input to port M2 of the network 27 results in outputs at ports P1 to P5 having equal amplitudes to one another, with phases relative to the signal at P1 of 0, $4\pi/5$, or $8\pi/5$, $12\pi/5$ or $16\pi/5$ radians respectively. This set of signals is orthogonal to all of the aforementioned modes apart from mode number n=+2, and thus excites only this mode, and no other. In this way, a signal input at mode port M1 excites only mode number n=+1 on the ring slot array, and a signal input at M2 excites only mode number n=+2.

Any desired combination of these modes may be achieved by superposition. For example, to excite modes n=+1 and n=+2, with equal amplitude and a relative phase of $\pi/2$ radians, one would simply apply input signals of equal amplitude and relative phase of $\pi/2$ radians to the mode ports M1 and M2. In the example shown in FIG. 9, the amplitudes of the signals applied to each mode port of the network 27 are controlled independently by means of the variable amplifiers 25,26, and the relative phase between the signals is controlled by means of the phase-shifter 24.

In the case where the electrical length of the connections from the network 27 to the probes are non-negligible, the phase shift due to the connections must be compensated by an appropriate adjustment of the beam forming network 27.

FIG. 9 shows the probes 28–32 laid upon the underside of the substrate of the antenna 20. The probes are terminated in the nature of an open-circuit arrangement, with the ring slots 33,34 being excited by electromagnetic coupling of the excitation signal from the probes 28–32. In a mechanical sense, the probes simply have an end arranged to be just inside the inner edge of the inner ring slot 33.

Figure 10:
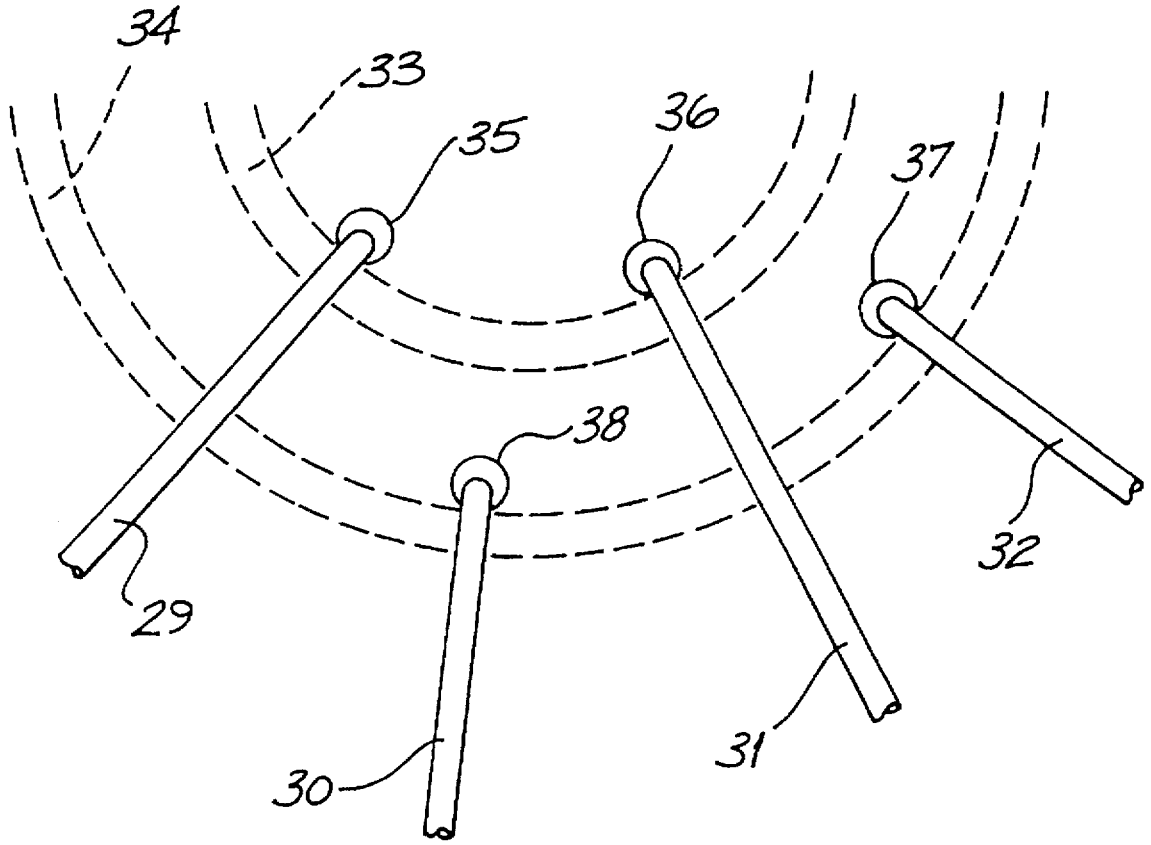
FIG. 10 is a plan view of an interconnection arrangement for a three ring-slot antenna arrangement.

An alternate termination arrangement is shown in FIG. 10. Here, four of the probes 29–32 (shown conveniently in a closer spaced arrangement) are again laid on the underside of the substrate for the antenna 20, but extend through respective holes 35–38 to the top side of the substrate and are electrically terminated at a point close to the inner edge of the inner ring slot 33. Thus the connection is in the nature of an electrical short-circuit.

Figure 11:
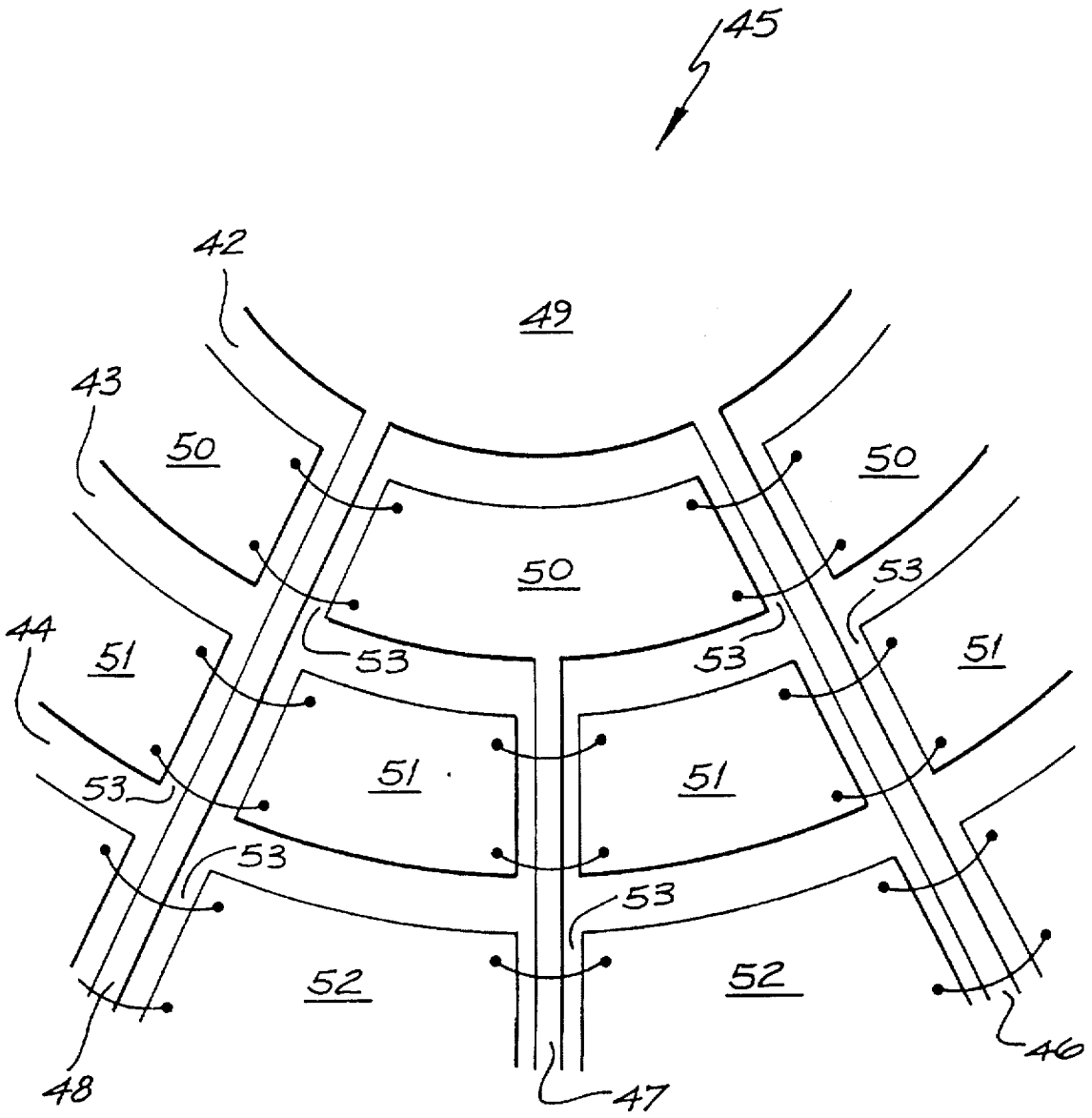
FIG. 11 is a plan view of another interconnection arrangement for a three ring-slot antenna.

A further alternative way of arranging the transmission lines 24 is illustrated in FIG. 11 for a three ring-slot antenna 45. Only three probes 46–48 are shown for convenience. The transmission lines 46–48 form part of the conductive layer on the substrate, and are thus formed (for example) by etching together with the inner conductor 49 and the two band conductors 50,51 and the outer conductor 52. In order to provide electrical continuity of the conductors, a number of air bridges 53 are provided. If a sufficient number of air bridges 53 are provided, there is no substantial loss of performance. The three ring-slots 42–44 are formed in the spaces between the conductors 49–52.

Figure 12:
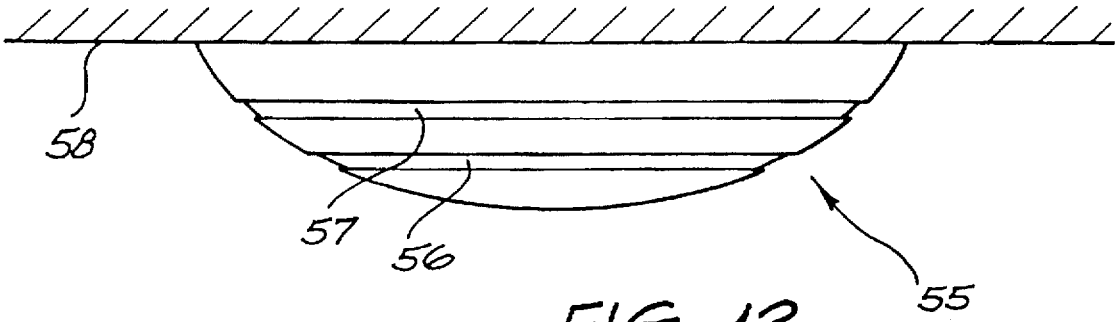
FIG. 12 is a side elevation view of a domed two ring-slot antenna.

It is not necessary for the antenna surface to be flat. FIG. 12 shows a dome antenna 55 with two ring-slots 56,57. This antenna represents a special case of a planar antenna, in that despite the domed structure, the ring-slots 56,57 remain planar and coaxial. An advantage of such an antenna is that the domed surface increases the radiation at the antenna horizon. The dome antenna 55 is able to be positioned below a ceiling 58 of a room, for example. It will be apparent to those skilled in the art that the antenna 55 radiates in two opposite directions away from the antenna's conductive surface.

Figure 13:
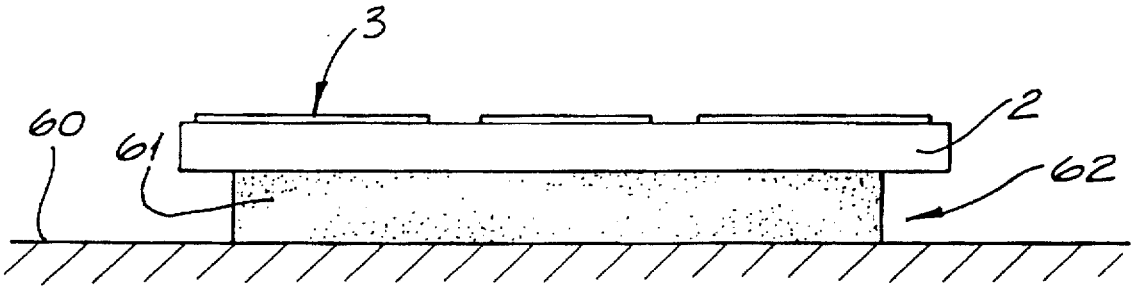
FIG. 13 is a side elevation view of reflective or absorbent mounting arrangements.

As indicated in FIG. 13, if desired, the substrate 2 of an antenna embodying the invention can be mounted above a suitably spaced reflector 60, the spacing between the reflector 60 and conductive layer 3 being arranged to reinforce the radiated signal. Alternatively, the space 62 between the conductive layer 3 and any base 61 can be filled with a material which can be either radiation absorbent or dielectric in nature.

Although in FIG. 13 the conductive layer 3 is illustrated on the farther side of the substrate 2 relative to the reflector 60, it will be apparent that the position of the substrate can be inverted so that the conductive layer 3 is adjacent the reflector 60.

The foregoing describes only some embodiments of the present invention and modifications, obvious to those skilled in the art, can be made thereto without departing from the scope of the present invention.

For example, the geometry need not be circular. Instead, the slots can be confocal ellipses, in which case Mathieu rather than Bessel functions arise in the description of the fields.

We claim:

1. A steerable antenna comprising an electrically conductive layer on a dielectric substrate, the conductive layer defining a plurality, k, of coaxial ring-slot radiating elements formed therethrough, and controllable signal feed means coupled to each said ring-slot element, and wherein said feed means selectively feed j of said k ring-slot radiating elements where j is in the range of 1 to k to excite a separate resonant mode on each of said ring-slot radiating elements, the mode excited being dependant upon the geometry of the respective said ring-slot radiating element, and generally lying in the plane of the conductive layer or the dielectric substrate, and wherein radiation due to said resonant modes combine by superposition in the far-field to produce a radiation pattern directional in azimuth and elevation, and said feed means is controllable in amplitude and phase to adjust the relative amplitude and relative phase of the excited modes to steer said radiation pattern in azimuth and elevation.

2. The antenna of claim 1, wherein said feed means comprises one or more microstrip probes coupling each said ring-slot radiating element to circuit means, said circuit means operable to adjust the relative phase and relative amplitude between each excited mode so that said radiation pattern is steerable.

3. The antenna of claim 2, wherein said probes are supported from the underside of said substrate.

4. The antenna of claim 3, wherein each said probe passes beneath a said ring-slot radiating element to couple an excitation signal to a respective said ring-slot radiating element.

5. The antenna of claim 3, wherein each said probe is electrically terminated to said conductive layer at a point proximate the inner wall of a said ring-slot radiating element.

6. The antenna of claim 2, wherein said circuit means includes one or more variable gain amplifiers to adjust said relative amplitude and one or more phase shifters to adjust said relative phase.

7. The antenna of claim 1, wherein said ring-slot radiating elements are circular, and the mode excited on a respective said ring-slot radiating element results for the effective circumference of a said ring-slot radiating element being an integral number of the excitation wavelength.

8. The antenna of claim 1, wherein there are k=3 said ring-slot radiating elements.

9. The antenna of claim 1, wherein said feed means comprises one or more coplanar waveguides coupling each said ring-slot radiating element to circuit means.

10. The antenna of claim 1, wherein said ring-slot radiating elements are elliptical having their respective major axes aligned.

11. The antenna of claim 1, wherein said electrically conductive layer and said dielectric substrate are shaped to form a dome.

12. The antenna of claim 1, further comprising a reflective sheet located behind and spaced apart from said dielectric substrate, and lying in a plane parallel with the plane of said dielectric substrate.

13. The antenna of claim 12, further comprising a radiation absorptive material located in a space formed between said reflective sheet and said dielectric substrate to form a base for said antenna.

14. The antenna of claim 1, wherein said feed means comprises one or more transmission lines formed in said conductive layer that intersect one or more of said ring-slot elements, electrical continuity of said conductive layer proximate the region of intersection being achieved by electrically conductive fly-overs.

15. A method of electronically steering a far-field radiation pattern of a planar antenna in elevation and azimuth, said antenna comprising an electrically conductive layer on a dielectric substrate, said conductive layer defining a plurality, k, of ring-slot radiating elements formed therethrough, and having controllable signal feed means coupled to each said ring-slot radiating element, said method comprising the steps of:

selectively feeding j of said k radiating elements, where j is in the range of 1 to k, to excite a separate resonant mode on each of said j radiating elements, the mode excited being dependent upon the geometry of the respective said ring-slot radiating elements and radiation due to said resonant modes combining by superposition in the far-field to produce a radiation pattern directional in azimuth and elevation; and adjusting the relative amplitude and relative phase of the excited modes to steer said radiation pattern in azimuth and elevation.

16. The method of claim 15, comprising the further step of adjusting the relative phase or relative amplitude between each said resonant mode to steer the azimuthal radiation pattern.

* * * * *